United States Patent [19]

Cudlip

[11] Patent Number: 4,721,305

[45] Date of Patent: Jan. 26, 1988

[54] NATURAL GRIP RACQUET

[76] Inventor: John B. Cudlip, P.O. Box 1040, Los Altos, Calif. 94022

[21] Appl. No.: 802,582

[22] Filed: Nov. 27, 1985

[51] Int. Cl.[4] ..... A63B 49/08

[52] U.S. Cl. ..... 273/73 J

[58] Field of Search ..... 273/29 A, 73 R, 73 J, 273/75, 67 R, 67 B, 81 R, 81.2; 135/72, 67, 76; 272/119; D21/210, 211, 212, 213, 222

[56] References Cited

U.S. PATENT DOCUMENTS

| | | | |
|---|---|---|---|
| 2,669,244 | 2/1954 | Greene et al. | 135/72 |
| 3,239,224 | 3/1966 | Finn et al. | 273/67 B |
| 3,269,399 | 8/1966 | Smith | 273/73 J X |
| 3,545,755 | 12/1970 | Owada | 273/75 |
| 3,833,219 | 9/1974 | Dean | 273/73 J |
| 3,931,968 | 1/1976 | Hedberg | 273/75 |
| 4,265,448 | 5/1981 | Anderson, Jr. | 273/75 |
| 4,676,505 | 6/1987 | Rodriguez et al. | 273/67 B |

FOREIGN PATENT DOCUMENTS

| | | | |
|---|---|---|---|
| 2100234 | 7/1972 | Fed. Rep. of Germany | 273/67 R |
| 3132487 | 3/1983 | Fed. Rep. of Germany | 273/75 |
| 3404831 | 8/1985 | Fed. Rep. of Germany | 273/73 J |
| 2525480 | 10/1983 | France | 273/67 R |

*Primary Examiner*—Anton O. Oechsle
*Assistant Examiner*—Matthew L. Schneider
*Attorney, Agent, or Firm*—Flehr, Hohbach, Test, Albritton & Herbert

[57] ABSTRACT

A racquet which includes a head, a throat, and a handle, the handle having a pair of spaced shaft arrangements with a grip extending between the shaft arrangements and spaced from the butt ends thereof. A wristband extends between the butt ends of the shaft arrangements for engaging the wrist of a player when he grasps the grip. In one embodiment, the positions of the grip and wristband are adjustable with respect to the racquet head and with respect to each other.

12 Claims, 18 Drawing Figures

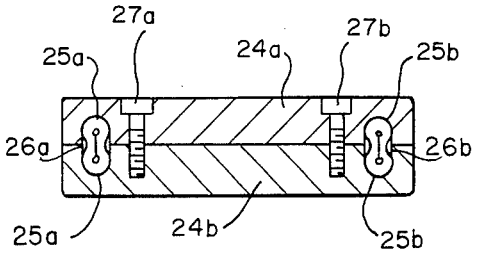
FIG. —7
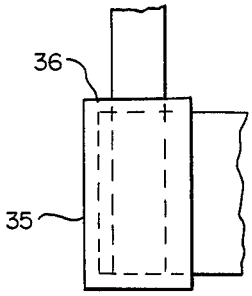
FIG. —11
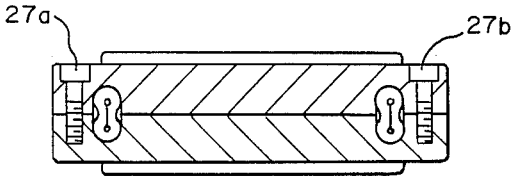
FIG. —8
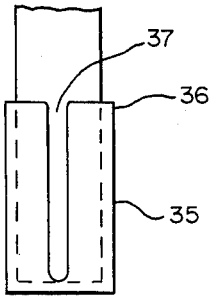
FIG. —12
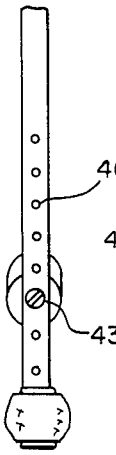
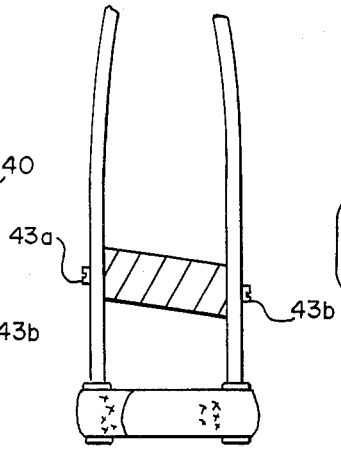
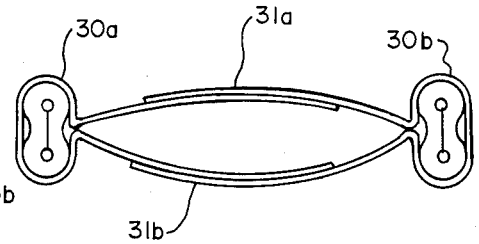
FIG. —13
FIG. —9 FIG. —10

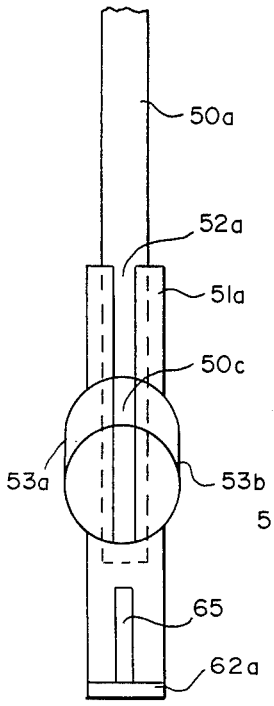
FIG.—14
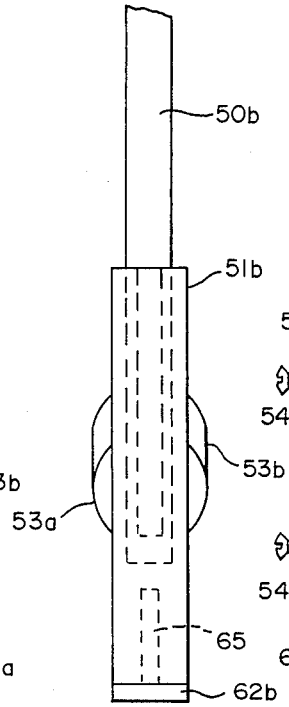
FIG.—15
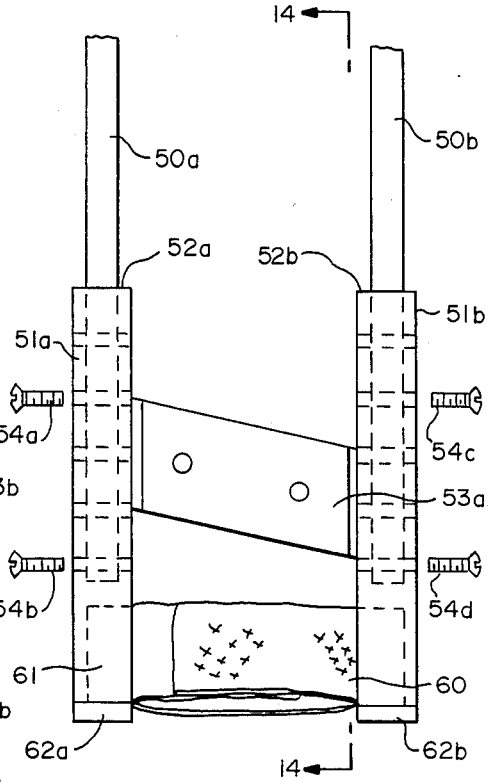
FIG.—16
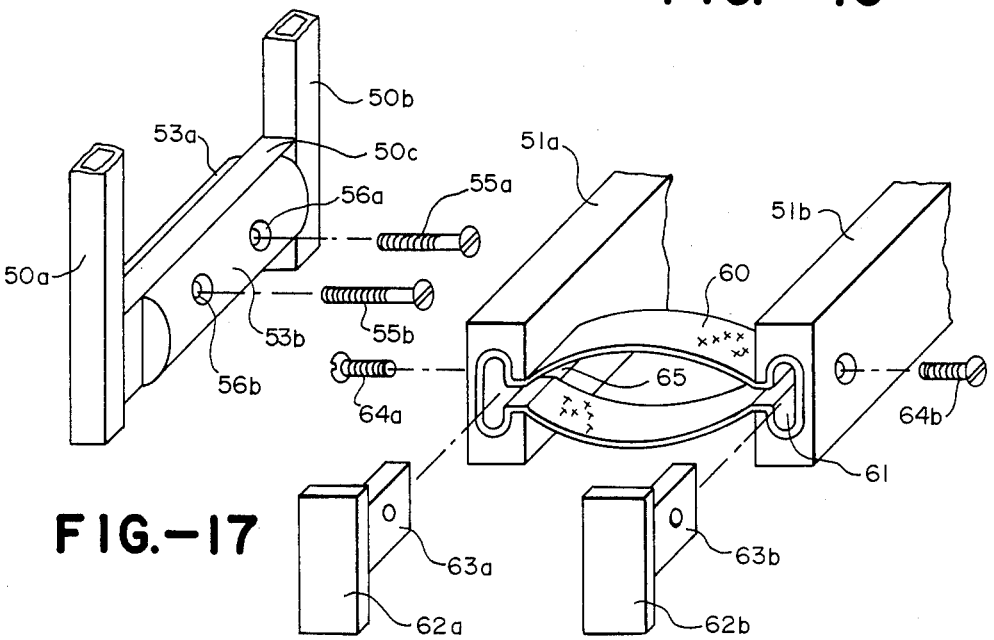
FIG.—17
FIG.—18

NATURAL GRIP RACQUET

The present invention relates generally to a racquet for use in sports such as tennis, racquetball, squash, badminton and the like and more particularly to a natural grip tennis racquet.

Racquets generally consist of a head, throat, and handle as shown in FIG. 1. The handle includes a grip which is grasped by hand with grip resting in palm. FIGS. 2 and 3 show typical positions of hand performance of forehand and backhand strokes. It is seen that handle is at an angle with respect to axis of a player's arm.

Typical positions of hand during play are uncomfortable, therefore cause discomfort in hand and consequently to wrist, forearm, elbow, upper arm, and shoulder whenever ball is struck by racquet. Furthermore, upon impact a twisting force is felt because racquet handle and player's arm are not aligned.

It is an object of the present invention to provide an improved racquet.

It is another object of the present invention to provide a racquet which can be held during play by normal human hand in a naturally comfortable manner.

It is another object of the present invention to provide a racquet whereby axis of racquet head, throat, and handle fundamentally align with axis of player's arm, thereby reducing strain in player's wrist, forearm, elbow, upper arm, and shoulder.

It is a further object of the present invention to provide a racquet whereby twisting torque resulting from striking ball is reduced.

It is still a further object of the present invention to provide a racquet having a handle designed so that it is not necessary to use different grips for forehand and backhand shots.

It is yet a further object of the present invention to provide a racquet having a handle design which can be easily adjusted for different size grips (both widthwise and circumferentially) and different wrist-to-grip lengths.

The foregoing and other objects of the invention are achieved by a racquet consisting of head, dual-shaft throat and handle and a transverse grip secured between shafts, and a wristband affixed to the butt end of shafts. The player's hand holds the grip in a comfortable, natural, fist-like manner with the wristband encircling his wrist. The angle of grip conforms to natural angle formed by palm of hand and the axis of racquet aligns with the axis of player's arm. The wristband assists in maintaining alignment plus providing additional support for the wrist during play.

The invention will be more clearly understood from the following description and drawings of which:

FIG. 7 is a sectional view showing one embodiment of the grip.

FIG. 8 is a sectional view showing another embodiment of the grip.

FIG. 9 is a right side elevational view of the handle showing another method of securing a grip.

FIG. 10 is a front elevational view of the handle shown in FIG. 9.

FIG. 11 shows a front elevational view of a clip for retaining the wristband.

FIG. 12 is a side elevational view of the clip in FIG. 11 without the wristband.

FIG. 13 is a sectional view taken along the line 13—13 of FIG. 4 showing the wristband and shafts.

FIGS. 14, 15, 16, 17 and 18 show another embodiment of the present invention in which:

FIG. 14 is a right-hand player's side elevational view of the right side of the left shaft taken along the line 14—14 of FIG. 16.

FIG. 15 is a side elevational view of the right side of the right shaft.

FIG. 16 is a front elevational view.

FIG. 17 is a perspective view of the grip section.

FIG. 18 is a perspective view of disassembled butt ends of the shafts showing an alternate way to retain the wristband.

Figure 1:
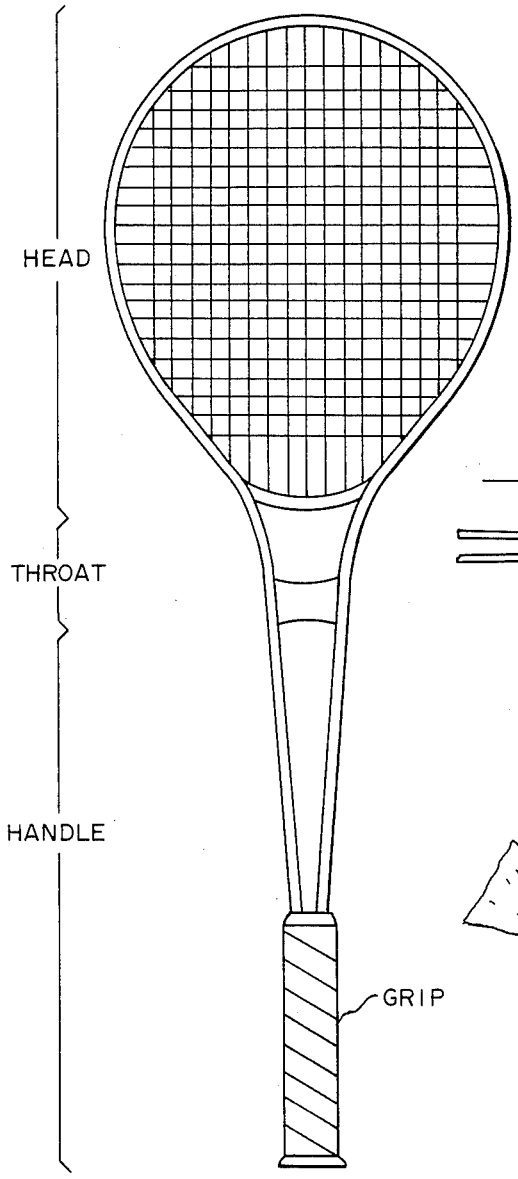
FIG.—1 PRIOR ART
FIG. 1 is a front elevational view of a prior art racquet.
Figure 2:
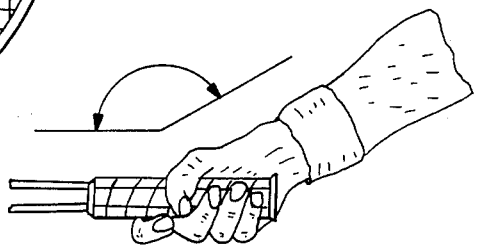
FIG.—2 PRIOR ART
FIG. 2 is a perspective view of a player's hand holding the handle of a prior art racquet in performance of a forehand stroke. The illustrated hold is known as the Eastern forehand grip.
Figure 3:
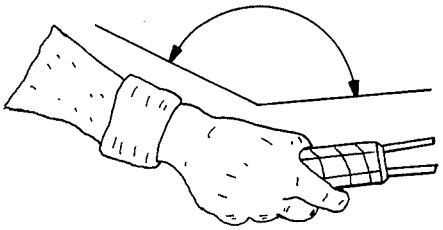
FIG.—3 PRIOR ART
FIG. 3 is a perspective view of a player's hand holding the handle of a prior art racquet in performance of a backhand stroke. The illustrated hold is known as the Eastern backhand grip.
Figure 4:
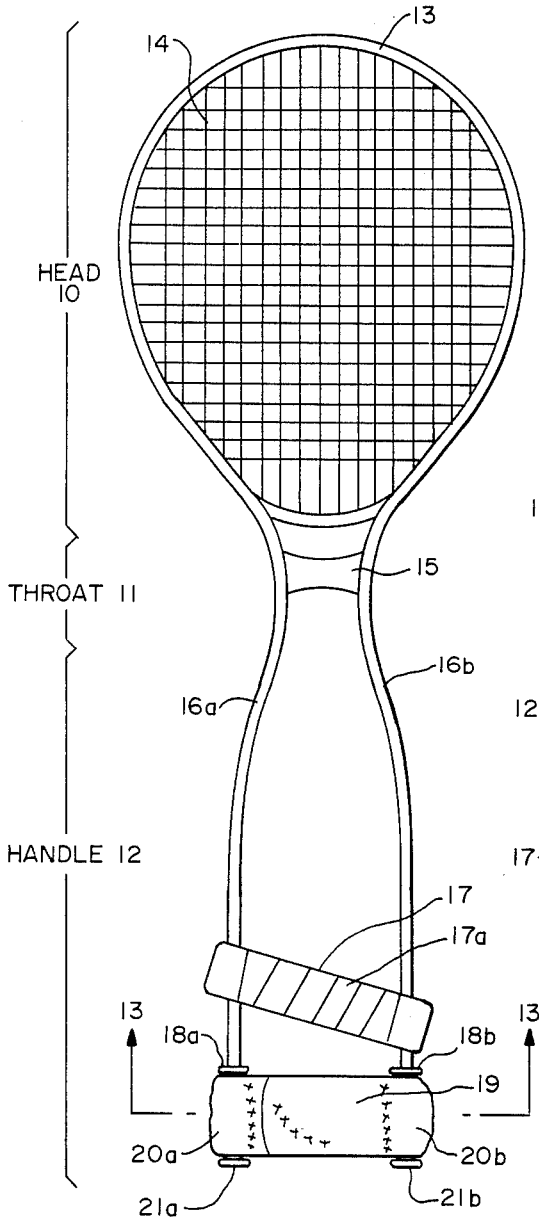
FIG. 4 is a right-hand player's front elevational view or alternatively a left-hand player's back elevational view of a racquet designed in accordance with one embodiment of the present invention.
Figure 5:
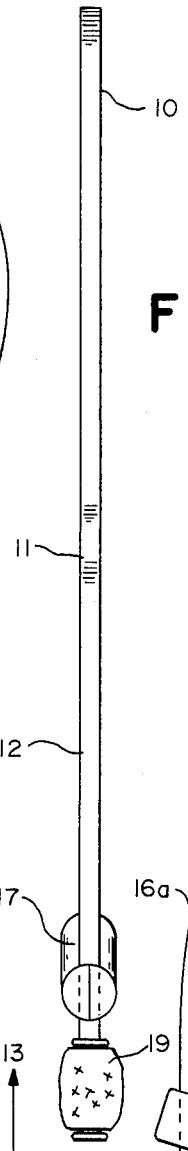
FIG. 5 is a right-hand player's side elevational view of the right side of the present invention.
Figure 6:
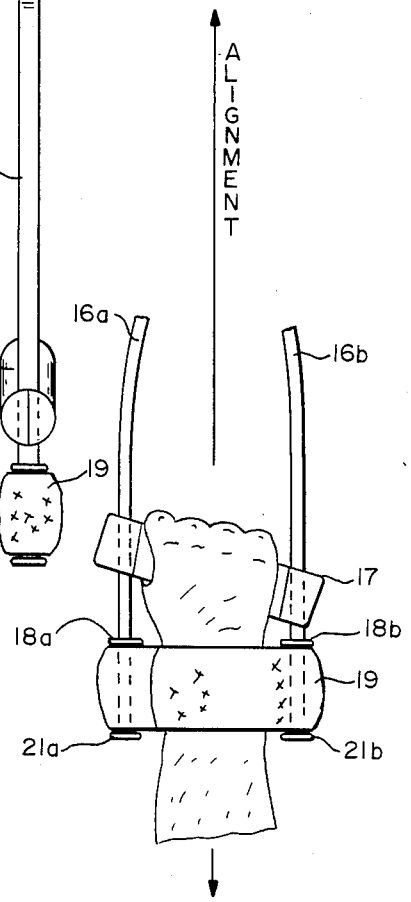
FIG. 6 is a perspective view showing a right-hand player's hand holding the grip of a racquet in accordance with the present invention with wristband encircling the wrist.

The racquet, in accordance with the invention, shown in FIGS. 4 and 5, comprises a head 10, which may be any desired shape; however, heads are generally oval shape. The head is strung with any suitable stringing material 14. A handle 12 extends away from and perpendicular to the head. The handle is attached to the head by the throat 11. The handle comprises a pair of spaced shafts **16*a* and 16*b* with grip 17 adjustably secured between them. Below the grip is a wristband 19 secured between butt ends of shafts. The grip 17 is inclined to conform to the natural angle of the human hand as illustrated in FIG. 6. While grasping the grip in a fist-like manner, hand and wrist are noticeably uncontorted and therefore comfortable. And the alignment of the axis of racquet with axis of player's forearm is apparent. It has been found that the angle of the grip with respect to a line which extends perpendicular to the shafts is between 10 to 18 degrees and preferably 14 degrees. The position of grip along shafts is adjustable, as will be presently described. The wristband 19 secured between butt ends of shafts is for encircling player's wrist. A bridge 15 may be provided on throat or at juncture of throat and handle. The grip, FIG. 7, may include two mating halves 24*a* and 24*b*, which are each provided with spaced grooves or notches 25*a* and 25*b*. When the grip halves 24*a* and 24*b* are mated, the notches form inclined openings 26*a* and 26*b* which fit over shafts 16*a* and 16*b*. The grip halves are secured to one another by screws 27*a* and 27*b* which extend through one grip portion 24*a* and are threadably received by the other grip portion 24*b*. By tightening the screws, the grip is secured to the shafts. Thus the grip may be adjustably positioned by loosening the screws and sliding the grip along shafts 16*a* and 16*b*. If a wrapping is positioned around the grip, it would, of course, first have to be removed. Alternately, the screws 27***a* and 27*b* may be positioned at the ends of the grip beyond shafts, FIG. 8, whereby a grip wrapping indicated generally at 17*a* in FIG. 4 need not be removed to adjustably position the grip.

The grip may be made of metal, plastic or other suitable material. The exterior surface may be knurled, thereby obviating the need for wrapping of leather or other material. Rather than round, the grip may be any other comfortable shape. It may even include finger grooves.

A wristband 21, FIG. 4, is shown in position on the lower end of shafts. Wristband encircles wrist of player, giving added support to wrist while preventing rotation of racquet around the axis of grip. The wristband may be made of elasticized fabric or any other suitable material, and it may be overstitched to form two loops 30*a* and 30*b*, FIG. 13, which fit around the shafts or alternately within the shafts, as will be presently described. The wristband may furthermore consist of two pairs of overlapping straps 13*a* and 31*b*. The straps are secured to each other by Velcro fastening or other suitable fasteners. Thus either or both pairs of straps may be detached when the player's hand is placed on the grip. Then the straps are fastened to encircle the wrist. The position of the grip relative to wristband is illustrated in FIG. 6. Wristband may be held in place on shafts by retainer caps 18*a*, 18*b*, 21*a* and 21*b*, FIG. 6, which may be molded, welded or otherwise made part of shafts. Alternately, the wristband may be held in place by cylindrical caps centered on the butt end of shafts as shown in FIGS. 11 and 12, and there welded, glued, or by other means of securement held firmly in place. Still referring to FIGS. 11 and 12, the wristband is installed by passing loops 30*a* and 30*b* (FIG. 13) over cylindrical caps in upward direction, then downward on shafts inside cylindrical caps. Loops then occupy space 36 between cap and shaft and portions of wristband extending from loops to straps is unrestricted due to slots 37 in cylindrical caps. Shape of normal human hand prevents upward travel of wristband.

Alternately, another method of making an adjustable grip and of securing the wristband is shown in FIGS. 14 through 18. Shafts 50*a* and 50*b* and grip bridge 50*c* are of singular mold, made from graphite, plastic, ceramic, or other suitable material, and fit inside shafts 51*a* and 51*b* made of like material. The grip bridge travels-freely up or down the slots 52*a* and 52*b* formed in shafts 51*a* and 51*b*. The grip bridge is adjustably secured at the desired distance from wristband 60 by screws 54*a*, 54*b* 54*c* and 54*d* which also secure shafts 50*a* and 51*a* and 50*b* and 51*b* to one another. In that way, the-distance between the wrist and the head can be varied making the racquet adjustable for children, adults, men and women alike. Grip shells 53*a* and 53*b* may be of various widths and thicknesses to fit various sizes of human hands. The shells may be made of plastic, metal, wood, or any other suitable material and in any desired configuration to comfortably fit in the palm of hand and fingers.

The shells may even overlap the grip bridge above and below, or completely encircle it. Grip shell 53*b* is secured to grip bridge by screws 55*a* and 55*b* which pass into threaded holes 56*a* and 56*b*, then through corresponding holes in grip bridge and are threadably received by corresponding holes in grip bridge 53*a*. Alternately, shells may be secured to grip bridge by process of glueing, strapping, or interlocking.

The rearwardmost ends of shafts 51*a* and 51*b* carrying wristband 60. The shaft includes slots 65 located on their confronting surfaces and extending short distances from the open ends at the back of the racquet toward the head end. In that way, the wristband can be inserted into the slots so that sections 61 form loops therein. End caps 62*a*, 62*b* having projections 63*a*, 63*b* can be force fit within the open ends of the extensions such that the projections fit within the loops of sections 61 for holding the wristband in place. Screws 64*a*, 64*b* secure the caps 62*a*, 62*b* in the shafts 51*a*, 51*b*.

It should be apparent from the discussion immediately above that the position of wristband 60 with respect to both racquet head 10 and the grip bridge 50*c* depends upon the positions of shafts 51*a*, 51*b* along shafts 50*a* and 50*b*. More specifically, the position of the wristband relative to the racquet head and grip can be varied by varying the positions of the hollow shafts 51*a*, 51*b* along the shafts. Once each of the extensions is moved to the desired position on its associated shaft, it can be fixedly held in place in the manner shown in FIG. 16. As seen, screws 54*a*, 54*b*, 54*c* and 54*d* adjustably secure the shafts 51*a*, 51*b* to the shafts 50*a*, 50*b*.

It is to be understood that the invention is not limited to the illustrative embodiments shown. A racquet embodying the present invention may be constructed of aluminum, boron, graphite, magnesium, plastic, wood or other material and may be of various designs. The scope of the invention is defined by the appended claims rather than the illustrative description.

What is claimed is:

1. In a racquet of the type including a frame defining a head portion and frame extensions extending from said head portion converging to a throat and extending to form a handle terminating at a butt end, the improvement comprising said frame extensions being spaced apart along the length of the handle a sufficient distance so as to accommodate therebetween the hand of a player, a grip adapted to be grasped by a player's hand in its natural position mounted transversely between said frame extensions spaced from the butt end thereof and inclined with respect to the frame extensions to naturally receive the hand whereby the frame extensions form a continuation of the forearm and band means extending between said extensions at said butt end for engaging the wrist of a player when he grasps the grip.

2. A racquet as in claim 1 in which means are provided for releasably securing the grip to the pair of spaced frame extensions.

3. A racquet as in claim 2 in which said adjusting means comprises a split grip the ends of which engage the pair of spaced frame extensions.

4. A racquet as in claim 1 including means for adjusting the position of the grip along the pair of frame extensions.

5. A racquet as in claim 1 in which said band means comprises a wristband.

6. A racquet as in claim 5 in which the band means comprises adjustable straps.

7. A racquet as in claim 6 in which the band means includes loops which fit over the pair of frame extensions.

8. A racquet as in claim 7 in which the two loops are formed by passing the band means through spaced members secured to each of the pair of shaft means.

9. A racquet as in claim 1 in which the grip is configured to fit the hand of a player.

10. A racquet as in claim 1 including first means for adjusting the postiion of the grip relative to the racquet head and second means different than said last mentioned first means for adjusting the position of the band means relative to the racquet's head, whereby the positions of said grip and band means can be adjusted relative to one another.

11. A racquet as in claim 10 wherein said pair of spaced frame extensions include a pair of tubular shaft means respectively positioned around said frame extensions for movement along the latter and means for fixedly connecting said extensions at different positions along said frame extensions.

12. A racquet as in claim 1 wherein said grip includes disengageably connectable means.

* * * * *